US011713913B2

(12) United States Patent
Junge et al.

(10) Patent No.: US 11,713,913 B2
(45) Date of Patent: Aug. 1, 2023

(54) AUTOMATIC ICE MAKER INCLUDING A SECONDARY WATER SUPPLY FOR AN EXTERIOR OF AN ICE MOLD

(71) Applicant: Haier US Appliance Solutions, Inc., Wilmington, DE (US)

(72) Inventors: Brent Alden Junge, Evansville, IN (US); Bart Andrew Nuss, Fisherville, KY (US); Stuart Murphy, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 17/524,345

(22) Filed: Nov. 11, 2021

(65) Prior Publication Data

US 2023/0141535 A1 May 11, 2023

(51) Int. Cl.
*F25C 1/25* (2018.01)
*F25C 1/24* (2018.01)

(52) U.S. Cl.
CPC ..... *F25C 1/25* (2018.01); *F25C 1/24* (2013.01); *F25C 2400/14* (2013.01)

(58) Field of Classification Search
CPC ..... F25C 5/08; F25C 2400/14; F25C 1/045; F25C 1/25; F25C 1/24
See application file for complete search history.

(56) References Cited

U.S. PATENT DOCUMENTS

| | | | | |
|---|---|---|---|---|
| 4,075,868 | A | 2/1978 | Bartholmey | |
| 6,681,580 | B2 | 1/2004 | Shedivy | |
| 7,340,913 | B2 | 3/2008 | Miller | |
| 2019/0101316 | A1 * | 4/2019 | Hong | F25D 17/08 |

FOREIGN PATENT DOCUMENTS

| | | | | |
|---|---|---|---|---|
| JP | 2003042619 | * | 2/2003 | F25C 1/045 |

OTHER PUBLICATIONS

English language translation of JP 2003042619. Translated Dec. 2022 (Year: 2003).*

* cited by examiner

*Primary Examiner* — Cassey D Bauer
(74) *Attorney, Agent, or Firm* — Dority & Manning, P.A.

(57) ABSTRACT

A refrigerator appliance includes an ice maker provided within a cabinet of the appliance, the ice maker including a plurality of walls forming a receiving space, a conductive ice mold provided within the receiving space, the conductive ice mold defining an internal cavity and an exterior surface, a primary water supply positioned below the conductive ice mold to direct an ice-building spray of water to the conductive ice mold, a heat exchanger disposed on the conductive ice mold to draw heat therefrom, and a secondary water supply provided adjacent the exterior surface of the conductive ice mold. The secondary water supply dispenses ice-melting water over the exterior surface of the conductive ice mold.

18 Claims, 10 Drawing Sheets

AUTOMATIC ICE MAKER INCLUDING A SECONDARY WATER SUPPLY FOR AN EXTERIOR OF AN ICE MOLD

FIELD OF THE INVENTION

The present subject matter relates generally to refrigerator appliances, and more particularly to improving a harvest of ice from an ice mold of an ice making appliance within a refrigerator appliance.

BACKGROUND OF THE INVENTION

In domestic and commercial applications, ice is often formed as solid cubes, such as crescent cubes or generally rectangular blocks. The shape of such cubes is often dictated by the container holding water during a freezing process. For instance, an ice maker can receive liquid water, and such liquid water can freeze within the ice maker to form ice cubes. In particular, certain ice makers include a freezing mold that defines a plurality of cavities. Although the typical solid cubes or blocks may be useful in a variety of circumstances, they have certain drawbacks. For instance, such typical cubes or blocks are fairly cloudy due to impurities found within the freezing mold or water. As a result, certain consumers find clear ice preferable to cloudy ice. In clear ice formation processes, dissolved solids typically found within water (e.g., tap water) are separated out and essentially pure water freezes to form the clear ice.

However, further improvements are necessary to improve the creation and harvest of the clear ice cubes. For instance, in a spray up ice maker, excess water may freeze along an outer surface of the ice mold. This frozen outer surface may inhibit the harvest of the formed ice cubes, as a layer of ice on the outer surface must be removed prior to ejecting the ice from the mold. Accordingly, an ice maker that obviates one or more of the above-mentioned drawbacks would be beneficial. In particular, an ice maker that eliminates the formation of ice along the outer surface of an ice mold would be useful.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, an ice maker appliance is provided. The ice maker appliance may include a plurality of walls forming a receiving space; a conductive ice mold provided within the receiving space, the conductive ice mold defining an internal cavity and an exterior surface; a primary water supply positioned below the conductive ice mold to direct an ice-building spray of water to the internal cavity of the conductive ice mold; a heat exchanger disposed on the conductive ice mold to draw heat therefrom; and a secondary water supply provided adjacent the exterior surface of the conductive ice mold, wherein the secondary water supply dispenses ice-melting water over the exterior surface of the conductive ice mold.

In another exemplary aspect of the present disclosure, a refrigerator appliance is disclosed. The refrigerator appliance may include a cabinet defining one or more chilled chambers; a refrigerant system mounted within the cabinet to selectively cool the one or more chilled chambers, the refrigerant system including a compressor and an evaporator in fluid communication with the compressor; and an ice maker mounted within one of the one or more chilled chambers. The ice maker may include a plurality of walls forming a receiving space; a conductive ice mold provided within the receiving space, the conductive ice mold defining an internal cavity and an exterior surface; a primary water supply positioned below the conductive ice mold to direct an ice-building spray of water to the conductive ice mold; a heat exchanger disposed on the conductive ice mold to draw heat therefrom; and a secondary water supply provided adjacent the exterior surface of the conductive ice mold, wherein the secondary water supply dispenses ice-melting water over the exterior surface of the conductive ice mold.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
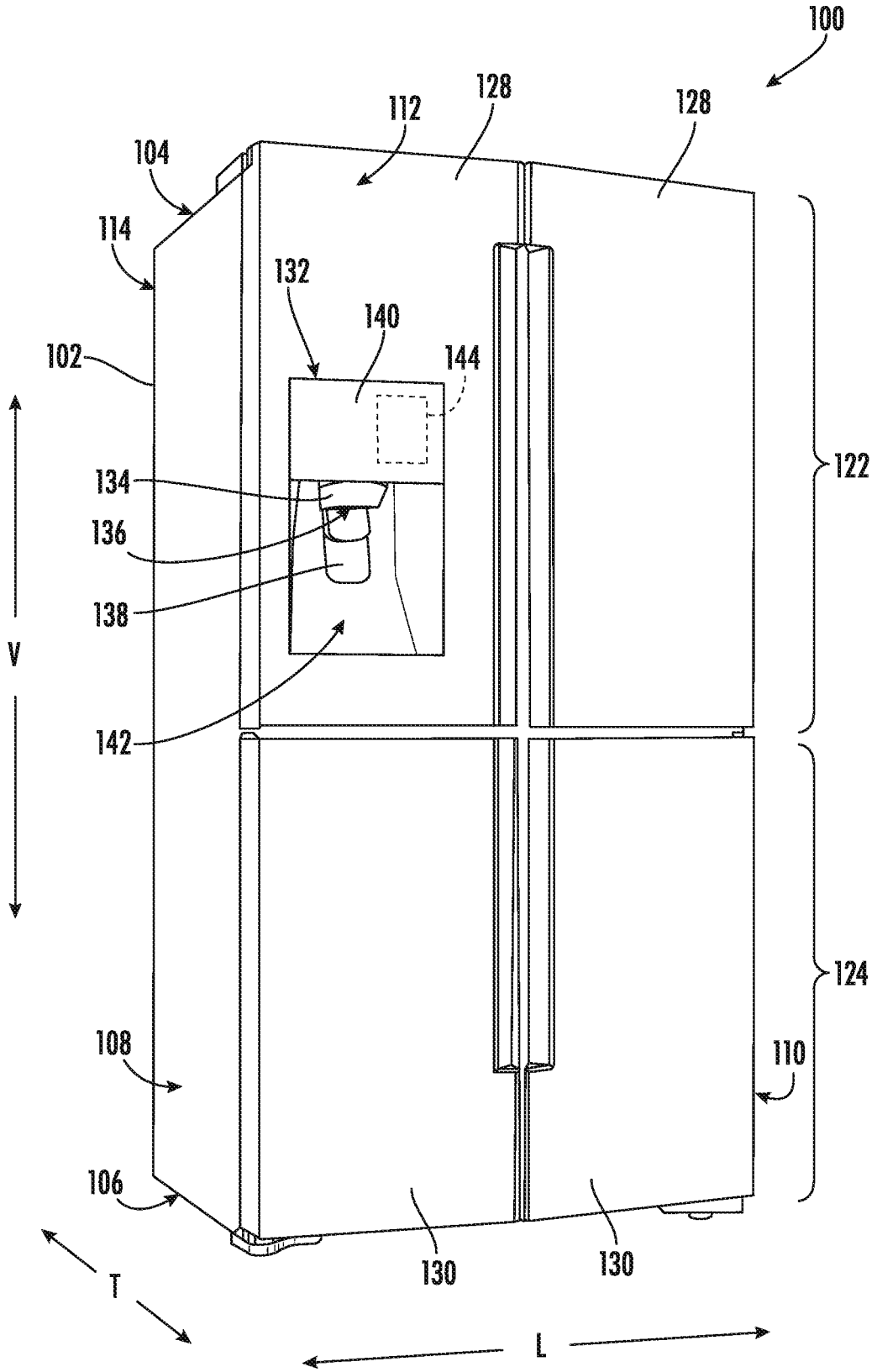
FIG. 1 provides a perspective view of a refrigerator appliance according to exemplary embodiments of the present subject disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "or" is generally intended to be inclusive (i.e., "A or B" is intended to mean "A or B or both"). The phrase "in one embodiment," does not necessarily refer to the same embodiment, although it may.

The terms "first," "second," and "third" may be used interchangeably to distinguish one component from another and are not intended to signify location or importance of the individual components. The terms "upstream" and "downstream" refer to the relative flow direction with respect to fluid flow in a fluid pathway. For example, "upstream" refers to the flow direction from which the fluid flows, and "downstream" refers to the flow direction to which the fluid flows.

FIG. 1 provides a perspective view of a refrigerator appliance 100 according to an exemplary embodiment of the present subject matter. Refrigerator appliance 100 includes a cabinet or housing 102 that extends between a top 104 and a bottom 106 along a vertical direction V, between a first side 108 and a second side 110 along a lateral direction L, and between a front side 112 and a rear side 114 along a transverse direction T. Each of the vertical direction V, lateral direction L, and transverse direction T are mutually perpendicular to one another.

Housing 102 defines chilled chambers for receipt of food items for storage. In particular, housing 102 defines fresh food chamber 122 positioned at or adjacent top 104 of housing 102 and a freezer chamber 124 arranged at or adjacent bottom 106 of housing 102. As such, refrigerator appliance 100 is generally referred to as a bottom mount refrigerator. It is recognized, however, that the benefits of the present disclosure apply to other types and styles of refrigerator appliances such as, e.g., a top mount refrigerator appliance or a side-by-side style refrigerator appliance. Consequently, the description set forth herein is for illustrative purposes only and is not intended to be limiting in any aspect to any particular refrigerator chamber configuration.

Refrigerator doors 128 are rotatably hinged to an edge of housing 102 for selectively accessing fresh food chamber 122. Similarly, freezer doors 130 are rotatably hinged to an edge of housing 102 for selectively accessing freezer chamber 124. To prevent leakage of cool air, refrigerator doors 128, freezer doors 130, or housing 102 may define one or more sealing mechanisms (e.g., rubber gaskets, not shown) at the interface where the doors 128, 130 meet housing 102. Refrigerator doors 128 and freezer doors 130 are shown in the closed configuration in FIG. 1 and in the open configuration in FIG. 2. It should be appreciated that doors having a different style, position, or configuration are possible and within the scope of the present subject matter.

Refrigerator appliance 100 also includes a dispensing assembly 132 for dispensing liquid water or ice. Dispensing assembly 132 includes a dispenser 134 positioned on or mounted to an exterior portion of refrigerator appliance 100, e.g., on one of refrigerator doors 128. Dispenser 134 includes a discharging outlet 136 for accessing ice and liquid water. An actuating mechanism 138, shown as a paddle, is mounted below discharging outlet 136 for operating dispenser 134. In alternative exemplary embodiments, any suitable actuating mechanism may be used to operate dispenser 134. For example, dispenser 134 can include a sensor (such as an ultrasonic sensor) or a button rather than the paddle. A control panel 140 is provided for controlling the mode of operation. For example, control panel 140 includes a plurality of user inputs (not labeled), such as a water dispensing button and an ice-dispensing button, for selecting a desired mode of operation such as crushed or non-crushed ice.

Discharging outlet 136 and actuating mechanism 138 are an external part of dispenser 134 and are mounted in a dispenser recess 142. Dispenser recess 142 is positioned at a predetermined elevation convenient for a user to access ice or water and enabling the user to access ice without the need to bend-over and without the need to open refrigerator doors 128. In the exemplary embodiment, dispenser recess 142 is positioned at a level that approximates the chest level of a user. According to an exemplary embodiment, the dispensing assembly 132 may receive ice from an icemaker or icemaking assembly 300 disposed in a sub-compartment of the refrigerator appliance 100 (e.g., IB compartment 180).

Refrigerator appliance 100 further includes a controller 144. Operation of the refrigerator appliance 100 is regulated by controller 144 that is operatively coupled to or in operative communication with control panel 140. In one exemplary embodiment, control panel 140 may represent a general purpose I/O ("GPIO") device or functional block. In another exemplary embodiment, control panel 140 may include input components, such as one or more of a variety of electrical, mechanical or electro-mechanical input devices including rotary dials, push buttons, touch pads, or touch screens. Control panel 140 may be in communication with controller 144 via one or more signal lines or shared communication busses. Control panel 140 provides selections for user manipulation of the operation of refrigerator appliance 100. In response to user manipulation of the control panel 140, controller 144 operates various components of refrigerator appliance 100. For example, controller 144 is operatively coupled or in communication with various components of a sealed system, as discussed below. Controller 144 may also be in communication with a variety of sensors, such as, for example, chamber temperature sensors or ambient temperature sensors. Controller 144 may receive signals from these temperature sensors that correspond to the temperature of an atmosphere or air within their respective locations.

In some embodiments, controller 144 includes memory and one or more processing devices such as microprocessors, CPUs or the like, such as general or special purpose microprocessors operable to execute programming instructions or micro-control code associated with operation of refrigerator appliance 100. The memory can represent random access memory such as DRAM, or read only memory such as ROM or FLASH. The processor executes programming instructions stored in the memory. The memory can be a separate component from the processor or can be included onboard within the processor. Alternatively, controller 144 may be constructed without using a microprocessor (e.g., using a combination of discrete analog or digital logic circuitry; such as switches, amplifiers, integrators, comparators, flip-flops, AND gates, and the like; to perform control functionality instead of relying upon software).

Figure 2:
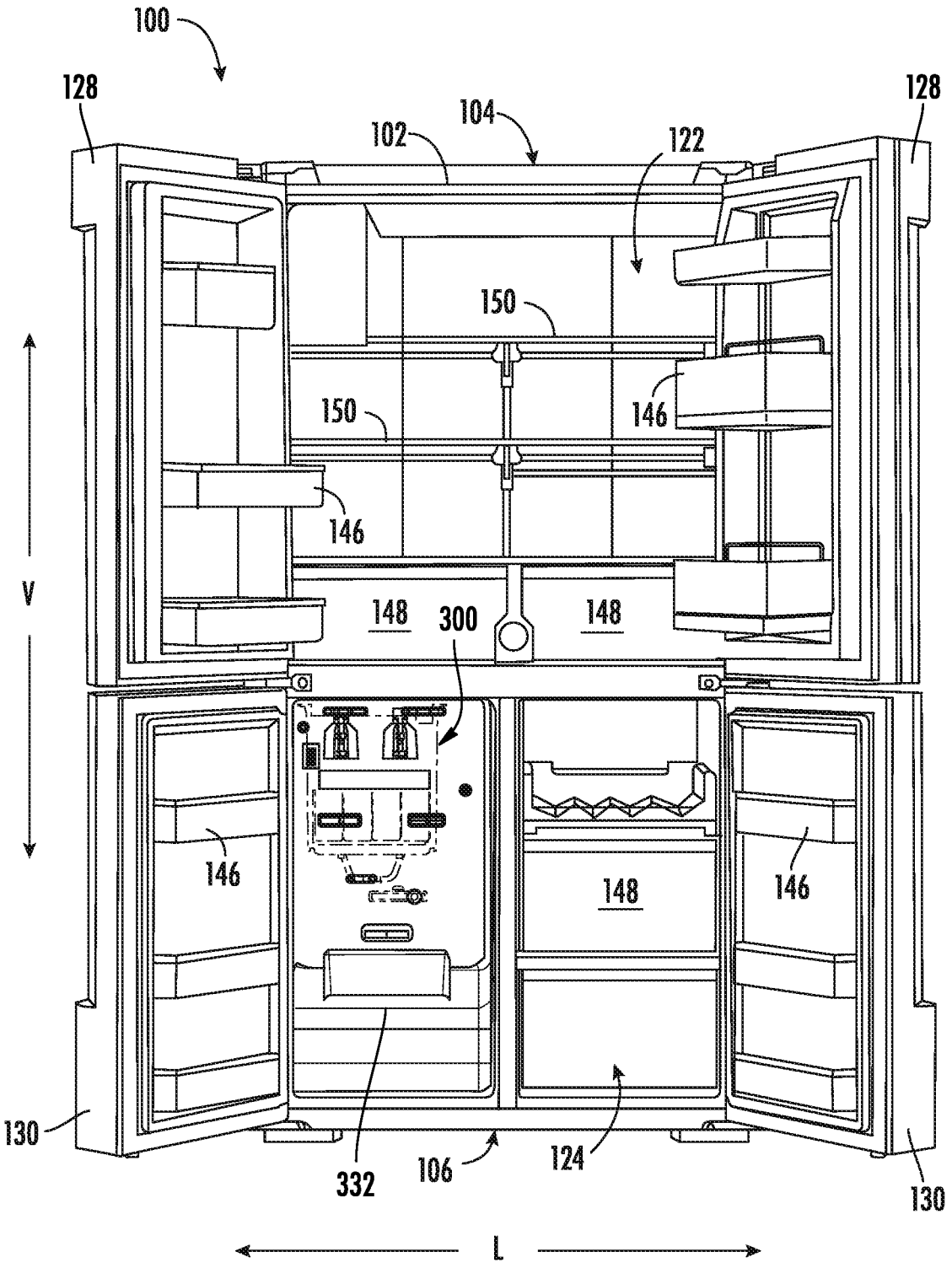
FIG. 2 provides a front view of the exemplary refrigerator appliance of FIG. 1 with the refrigerator and freezer doors shown in an open position.

FIG. 2 provides a front view of refrigerator appliance 100 with refrigerator doors 128 and freezer doors 130 shown in an open position. According to the illustrated embodiment, various storage components are mounted within fresh food chamber 122 and freezer chamber 124 to facilitate storage of food items therein as will be understood by those skilled in the art. In particular, the storage components include bins 146, drawers 148, and shelves 150 that are mounted within fresh food chamber 122 or freezer chamber 124. Bins 146, drawers 148, and shelves 150 are configured for receipt of food items (e.g., beverages or solid food items) and may assist with organizing such food items. As an example, drawers 148 can receive fresh food items (e.g., vegetables, fruits, or cheeses) and increase the useful life of such fresh food items.

Figure 3:
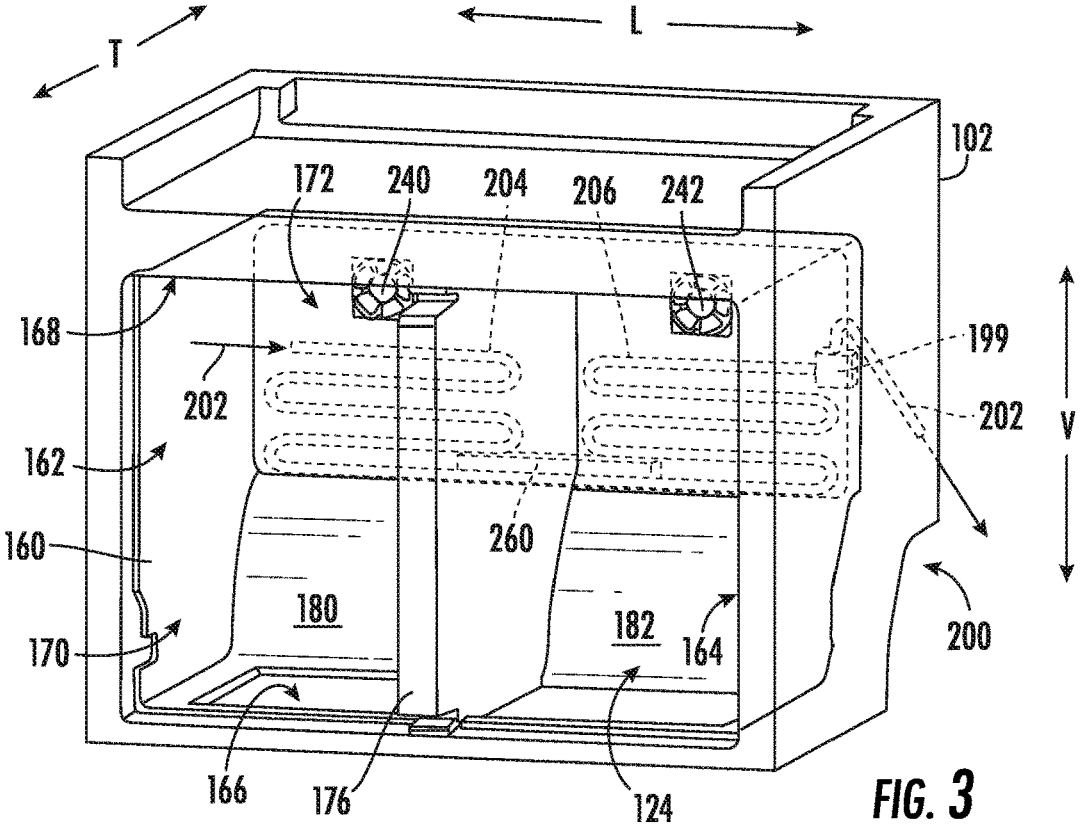
FIG. 3 provides a perspective view of a freezer chamber of the exemplary refrigerator appliance of FIG. 1 with the freezer doors and storage bins removed for clarity.
Figure 4:
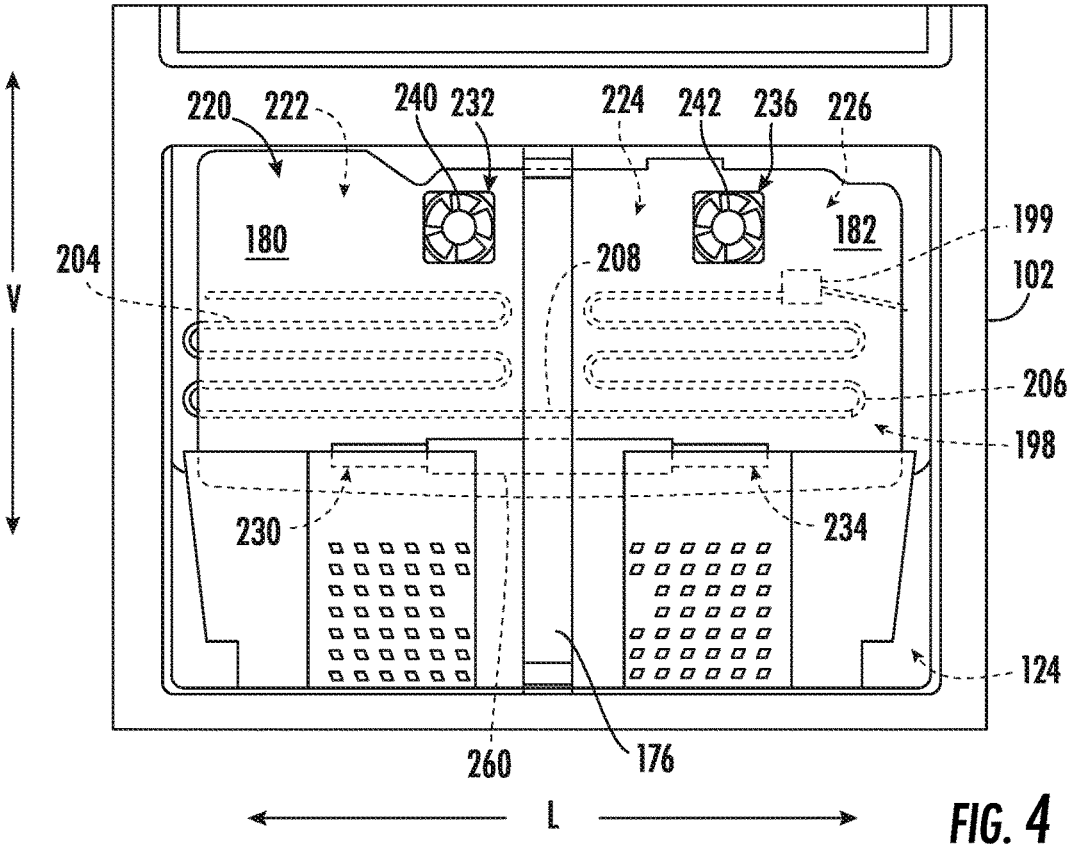
FIG. 4 provides a front elevation view of the exemplary freezer chamber of FIG. 3.

Referring now to FIGS. 3 and 4, freezer chamber 124 will be described according to exemplary embodiments of the present disclosure. As illustrated, cabinet or housing 102 includes an inner liner 160 which defines freezer chamber 124. For example, inner liner 160 may be an injection-molded door liner attached to an inside of housing 102. Insulation (not shown), such as expandable foam can be present between housing 102 and inner liner 160 in order to assist with insulating freezer chamber 124. For example, sprayed polyurethane foam may be injected into a cavity defined between housing 102 and inner liner 160 after they are assembled. Freezer doors 130 may be constructed in a similar manner to assist in insulating freezer chamber 124.

Freezer chamber 124 generally extends between a left wall 162 and a right wall 164 along the lateral direction L, between a bottom wall 166 and a top wall 168 along the vertical direction V, and between a chamber opening 170 and a back wall 172 along the transverse direction T. In some embodiments, refrigerator appliance 100 further includes a mullion 176 positioned within freezer chamber 124 to divided freezer chamber 124 into a pair of discrete sub-compartments, such as an icebox (IB) compartment 180 and a dedicated freezer (Fz) compartment 182. According to the illustrated embodiment, mullion 176 generally extends between chamber opening 170 and back wall 172 along the transverse direction T and between bottom wall 166 and top wall 168 along the vertical direction V. In this manner, mullion 176 is generally vertically-oriented and may split freezer chamber 124 into two equally-sized compartments 180, 182. Nonetheless, it should be appreciated that mullion 176 may be sized, positioned, and configured in any suitable manner to form separate freezer sub-compartments within freezer chamber 124. Moreover, alternative embodiments may be provided without any such mullion.

To limit heat transfer between IB compartment 180 and Fz compartment 182, mullion 176 may generally be formed from an insulating material such as foam. In addition, to provide structural support, a rigid injection molded liner or a metal frame may surround the insulating foam. According to another exemplary embodiment, mullion 176 may be a vacuum insulated panel or may contain a vacuum insulated panel to minimize heat transfer between IB compartment 180 and Fz compartment 182. Optionally, inner liner 160 or mullion 176 may include features such as guides or slides to ensure proper positioning, installation, and sealing of mullion 176 within inner liner 160.

Figure 5:
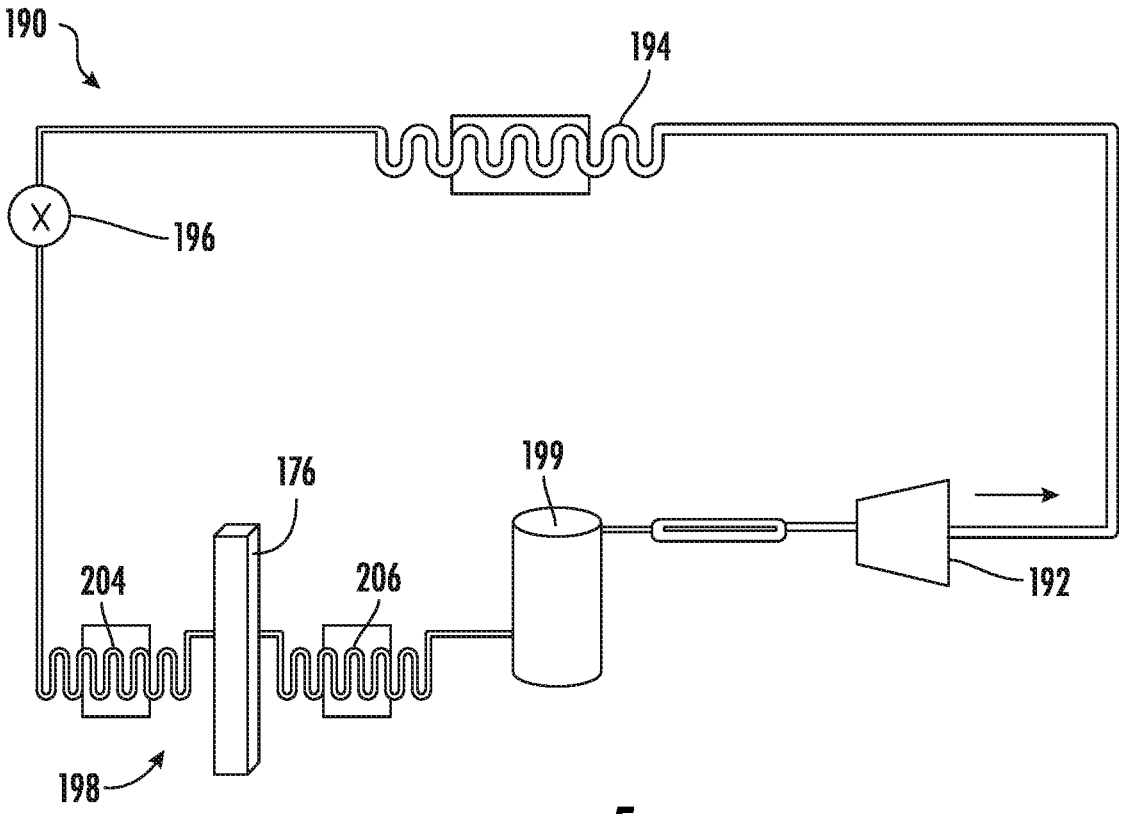
FIG. 5 provides a schematic view of a sealed cooling system of the exemplary refrigerator appliance of FIG. 1.
Figure 6:
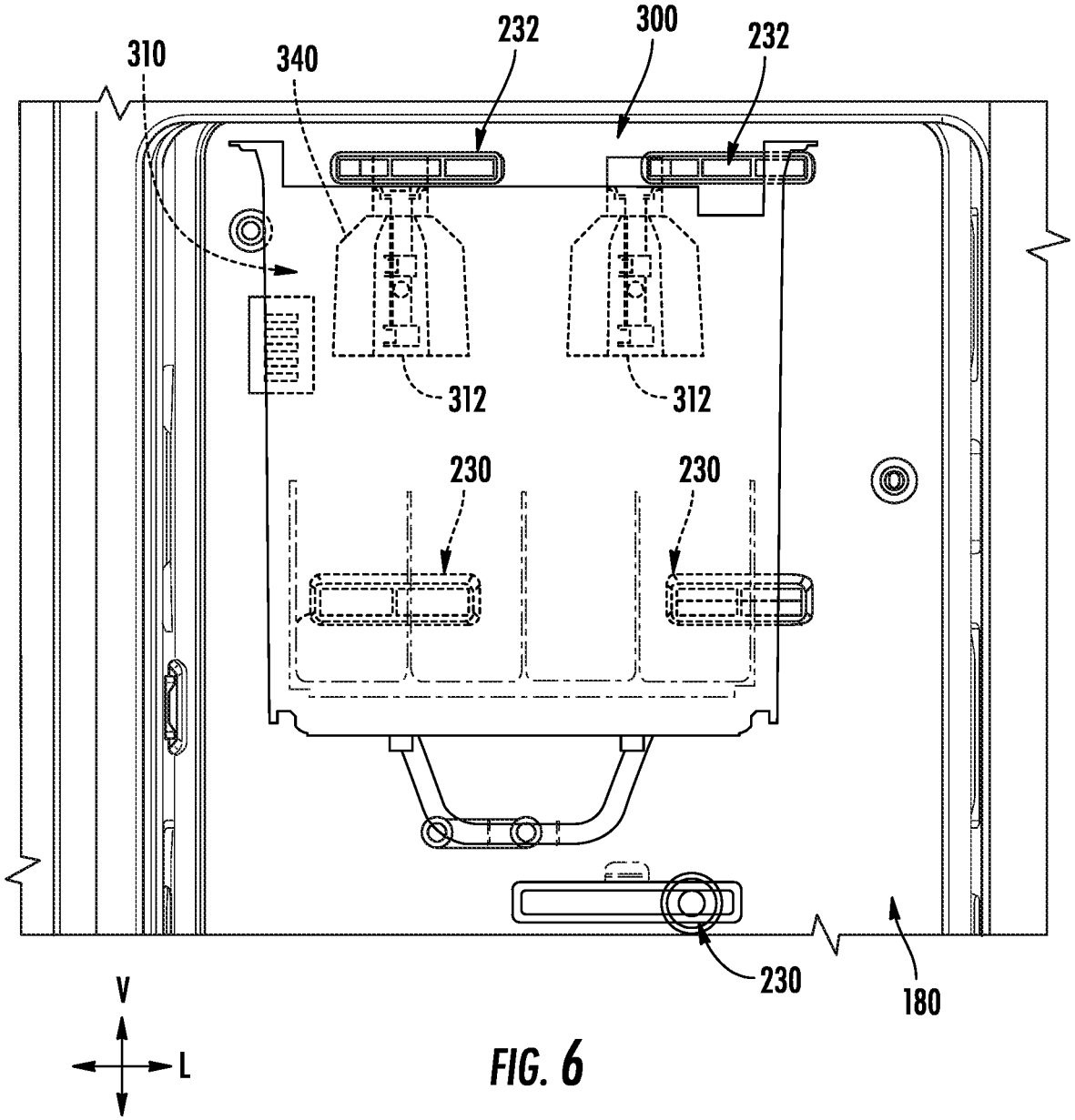
FIG. 6 provides a front elevation view of an ice making assembly within an icebox compartment of the exemplary refrigerator appliance of FIG. 2.
Figure 7:
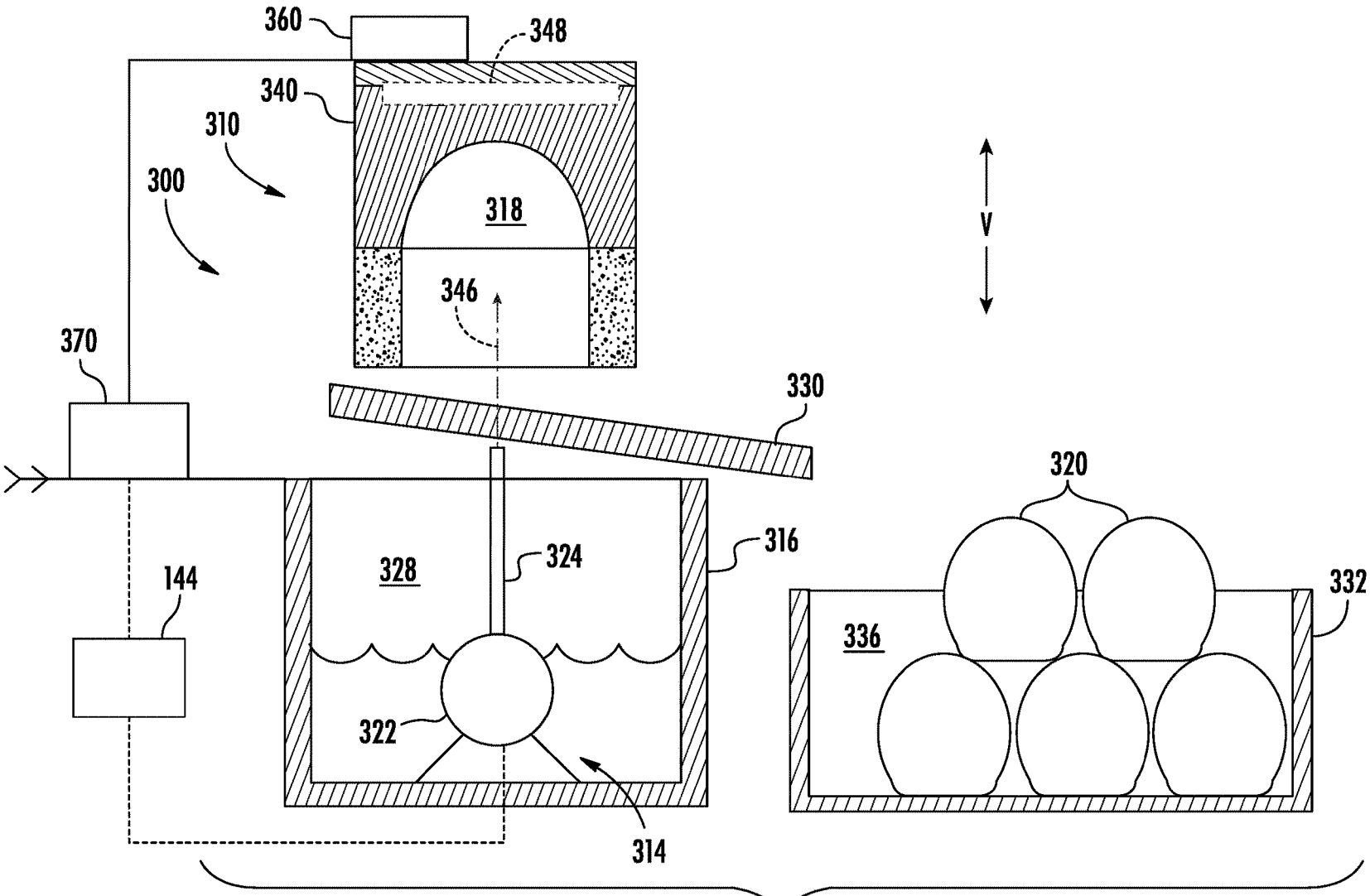
FIG. 7 provides a schematic view of an ice making assembly according to exemplary embodiments of the present disclosure.

Referring now to FIG. 5, a schematic view of an exemplary sealed system 190 which may be used to cool freezer chamber 124 will be described. Sealed system 190 is generally configured for executing a vapor compression cycle for cooling air within refrigerator appliance 100 (e.g., within fresh food chamber 122 or freezer chamber 124). Sealed cooling system 190 includes a compressor 192, a condenser 194, an expansion device 196, and an evaporator 198 connected in fluid communication (e.g., in series) and charged with a refrigerant.

During operation of sealed system 190, gaseous refrigerant flows into compressor 192, which operates to increase the pressure of the refrigerant and motivate refrigerant through sealed system 190. This compression of the refrigerant raises its temperature, which is lowered by passing the gaseous refrigerant through condenser 194. Within condenser 194, heat exchange with ambient air takes place so as to cool the refrigerant and cause the refrigerant to condense to a liquid state.

Expansion device (e.g., an expansion valve, capillary tube, or other restriction device) 196 receives liquid refrigerant from condenser 194. From expansion device 196, the liquid refrigerant enters evaporator 198. Upon exiting expansion device 196 and entering evaporator 198, the liquid refrigerant drops in pressure and at least partially vaporizes. Due to the phase change of the liquid refrigerant, evaporator 198 is cool relative to fresh food and freezer chambers 122 and 124 of refrigerator appliance 100. As such, cooled air is produced and refrigerates fresh food and freezer chambers 122 and 124 of refrigerator appliance 100. Thus, evaporator 198 is a type of heat exchanger which transfers heat from air passing over evaporator 198 to refrigerant flowing through evaporator 198.

It should be appreciated that the illustrated sealed system 190 is only one exemplary configuration of sealed system 190 which may include additional components (e.g., one or more additional evaporators, compressors, expansion devices, or condensers). As an example, sealed cooling system 190 may include two evaporators. As a further example, sealed system 190 may further include an accumulator 199. Accumulator 199 may be positioned downstream of evaporator 198 and may be configured to collect condensed refrigerant from the refrigerant stream prior to passing it to compressor 192.

Referring again generally to FIGS. 3 and 4, in some embodiments, evaporator 198 is positioned adjacent back wall 172 of inner liner 160. The remaining components of sealed system 190 may be located within a machinery compartment 200 of refrigerator appliance 100. A conduit 202 may pass refrigerant into freezer chamber 124 to evaporator 198 through a fluid tight inlet and may pass refrigerant from evaporator 198 out of freezer chamber 124 through a fluid tight outlet.

According to the illustrated embodiments, evaporator 198 includes a first evaporator section 204 and a second evaporator section 206. First evaporator section 204 and second evaporator section 206 are connected in series such that refrigerant passes first through first evaporator section 204 before second evaporator section 206. More specifically, according to the illustrated embodiment, first evaporator section 204 and second evaporator section 206 are coupled by a transition tube 208. Transition tube 208 may be a separate connecting conduit or a part of the same tube forming evaporator 198. As illustrated, first evaporator section 204 is positioned within IB compartment 180 and second evaporator section 206 is positioned within Fz compartment 182. In this regard, transition tube 208 may pass through an aperture in mullion 176.

An evaporator cover may be placed over evaporator 198 to form an evaporator chamber with inner liner 160. For example, as illustrated, a first evaporator cover 220 is positioned within IB compartment 180 over evaporator 198, or more specifically, over first evaporator section 204. In this manner, inner liner 160, mullion 176, and first evaporator cover 220 define a first evaporator chamber 222 which houses first evaporator section 204. Similarly, a second evaporator cover 224 is positioned within Fz compartment 182 over evaporator 198, or more specifically, over second evaporator section 206. In this manner, inner liner 160, mullion 176, and second evaporator cover 224 define a second evaporator chamber 226 which houses second evaporator section 206.

Evaporator chambers 222, 226 may include one or more return ducts and supply ducts to allow air to circulate to and from IB compartment 180 and Fz compartment 182 (e.g., along one or more air paths). In exemplary embodiments, first evaporator cover 220 defines one or more first return ducts 230 for allowing air to enter first evaporator chamber 222 and one or more first supply ducts 232 for exhausting air out of first evaporator chamber 222 into IB compartment 180 (e.g., along a first air path 250). Additionally or alternatively, second evaporator cover 224 may define one or more second return ducts 234 for allowing air to enter second evaporator chamber 226 and one or more second supply ducts 236 for exhausting air out of second evaporator chamber 226 into Fz compartment 182 (e.g., along a second air path 252). According to the illustrated embodiment, a first return duct 230 and a second return duct 234 are positioned proximate a bottom of freezer chamber 224 (e.g., proximate bottom wall 166) and a first supply duct 232 and a second supply duct 236 are positioned proximate a top of freezer chamber 224 (e.g., proximate top wall 168). It should be appreciated, however, that according to alternative embodiments, any other suitable means for providing fluid communication between the evaporator chambers and the freezer compartments are possible and within the scope of the present disclosure.

Refrigerator appliance 100 may include one or more fans to assist in circulating air through evaporator 198 and chilling freezer compartments 180, 182. For example, according to the illustrated exemplary embodiment refrigerator appliance 100 includes a first fan 240 in fluid communication with first evaporator chamber 222 for urging air through first evaporator chamber 222. Optionally, first fan 240 may be an axial fan positioned within a first supply duct 232 for urging chilled air from first evaporator chamber 222 into IB compartment 180 through a first supply duct 232 while recirculating air through a first return duct 230 back into first evaporator chamber 222 to be re-cooled. Additionally or alternatively, refrigerator appliance 100 may include a second fan 242 in fluid communication with second evaporator chamber 226 for urging air through second evaporator chamber 226. Optionally, second fan 242 may be an axial fan positioned within a second supply duct 236 for circulating air between second evaporator chamber 226 and Fz compartment 182, as described above.

Turning especially to FIGS. 6 through 9, an ice making assembly (or ice maker) 300 may be mounted within IB compartment 180. It should be noted that while ice maker 300 is described herein as being installed within a refrigerator appliance, the disclosure and accompanying description may apply to a stand-alone ice maker in certain circumstances. Generally, ice making assembly 300 includes a mold assembly 310. Mold assembly 310 may include a conductive ice mold 340 that defines a mold cavity 318 within which an ice billet 320 may be formed. Moreover, conductive ice mold 340 may define an outer or exterior surface 319 opposite mold cavity 318. Moreover, in some embodiments, exterior surface 319 may include or be defined by a plastic cover surrounding ice mold 340. Accordingly, exterior surface may be referred to as a plastic cover 319. Optionally, a plurality of mold cavities 318 may be defined by mold assembly 310 (e.g., as discrete or connected ice building units 312) and spaced apart from each other (e.g., perpendicular to the vertical direction V, such as along the lateral direction L). Generally, mold assembly 310 may be positioned along an air path within IB compartment 180 between supply duct 232 and return duct 230. In some such embodiments, mold assembly 310 is vertically positioned between supply duct 232 and return duct 230.

As will be described in further detail below, mold assembly 310 may further include a heat exchanger 348 mounted thereon (e.g., in conductive thermal communication with each discrete ice building unit 312). For instance, heat exchanger 348 may be any suitable solid state, electrically-driven heat exchanger, such as a thermoelectric device (e.g., a Peltier cell). Heat exchanger 348 may include a first heat exchange end or side and a second heat exchange end or side. When activated, heat may be selectively directed between the ends. In particular, a heat flux created between the junction of the ends may draw heat from one end to the other end (e.g., as driven by an electrical current). In some embodiments, heat exchanger 348 is operably coupled (e.g., electrically coupled) to controller 144, which may thus control the flow of current to heat exchanger 348. During use, heat exchanger 348 may selectively draw heat from mold cavity 318, as will be further described below.

A water dispenser 314 positioned below mold assembly 310 may generally act to selectively direct the flow of water into mold cavity 318. Generally, water dispenser 314 includes a water pump 322 and at least one nozzle 324 directed (e.g., vertically) toward mold cavity 318. In embodiments wherein multiple discrete mold cavities 318 are defined by mold assembly 310, water dispenser 314 may include a plurality of nozzles 324 or fluid pumps vertically aligned with the plurality mold cavities 318. For instance, each mold cavity 318 may be vertically aligned with a discrete nozzle 324.

In some embodiments, a water basin 316 is positioned below the ice mold 340 (e.g., directly beneath mold cavity 318 along the vertical direction V). Water basin 316 includes a solid nonpermeable body and may define a vertical opening and interior volume 328 in fluid communication with mold cavity 318. When assembled, fluids, such as excess water falling from mold cavity 318, may pass into interior volume 328 of water basin 316 through the vertical opening. Optionally, a drain conduit may be connected to water basin 316 to draw collected water from the water basin 316 and out of IB compartment.

In certain embodiments, a guide ramp 330 is positioned between mold assembly 310 and water basin 316 along the vertical direction V. For example, guide ramp 330 may include a ramp surface that extends at a negative angle (e.g., relative to a horizontal direction, such as the transverse direction T) from a location beneath mold cavity 318 to another location spaced apart from water basin 316 (e.g., horizontally). In some such embodiments, guide ramp 330 extends to or terminates above an ice bin 332 (e.g., within IB compartment 180). Optionally, guide ramp 330 may define a perforated portion that is, for example, vertically aligned between mold cavity 318 and nozzle 324 or between mold cavity 318 and interior volume 328 (described in further detail below). One or more apertures are generally defined through guide ramp 330 at perforated portion. Fluids, such as water, may thus generally pass through perforated portion of guide ramp 330 (e.g., along the vertical direction V between mold cavity 318 and interior volume 328).

In exemplary embodiments, ice bin 332 generally defines a storage volume 336 and may be positioned below mold assembly 310 and mold cavity 318. Ice billets 320 formed within mold cavity 318 may be expelled from mold assembly 310 and subsequently stored within storage volume 336 of ice bin 332 (e.g., within IB compartment 180). In some such embodiments, ice bin 332 is positioned within IB compartment 180 and horizontally spaced apart from water dispenser 314 or mold assembly 310. Guide ramp 330 may span a horizontal distance above or to ice bin 332 (e.g., from mold assembly). As ice billets 320 descend or fall from mold cavity 318, the ice billets 138 may thus be motivated (e.g., by gravity) toward ice bin 150.

As shown, controller 144 may be in communication (e.g., electrical communication) with one or more portions of ice making assembly 300. In some embodiments, controller 144 is in communication with one or more fluid pumps (e.g., water pump 322), heat exchanger 348, and fan 240. Controller 144 may be configured to initiate discrete ice making operations and ice release operations. For instance, controller 144 may alternate the fluid source spray to mold cavity 318 and a release or ice harvest process, which will be described in more detail below.

During ice making operations, controller 144 may initiate or direct water dispenser 314 to motivate an ice-building spray (e.g., as indicated at arrows 346) through nozzle 324 and into mold cavity 318 (e.g., a through mold opening at the bottom end of mold cavity 318). Controller 144 may further direct fan 240 to motivate a chilled airflow (e.g., from evaporator 190 or section 204 along the air path 250) to convectively draw heat from within mold cavity 318 during the ice building spray 346. As the water from the ice-building spray 346 strikes mold assembly 310 within mold cavity 318, a portion of the water may freeze in progressive layers from a top end to a bottom end of mold cavity 318. Excess water (e.g., water within mold cavity 318 that does not freeze upon contact with mold assembly 310 or the frozen volume herein) and impurities within the ice-building spray 346 may fall from mold cavity 318 and, for example, to water basin 316. After an initial portion of ice has formed within the mold cavity 318, controller 144 may activate heat exchanger 348 to further draw heat from the ice mold cavity 318, thereby accelerating freezing of ice billet 320, notably, without requiring a significant power draw.

Once an ice billet 320 is formed within mold cavity 318, an ice release or harvest process may be performed in accordance with embodiments of the present disclosure. For instance, fan 240 may be restricted or halted to slow/stop the active chilled airflow. Moreover, controller 144 may first halt or prevent the ice-building spray 346 by de-energizing water pump 322. Additionally or alternatively, an electrical current to heat exchanger 348 may be reversed such that heat is delivered to mold cavity 318 from heat exchanger 348. Thus, controller 144 may slowly increase a temperature of heat exchanger 348 and ice mold 340, thereby facilitating partial melting or release of ice billets 320 from mold cavities 318.

Figure 9:
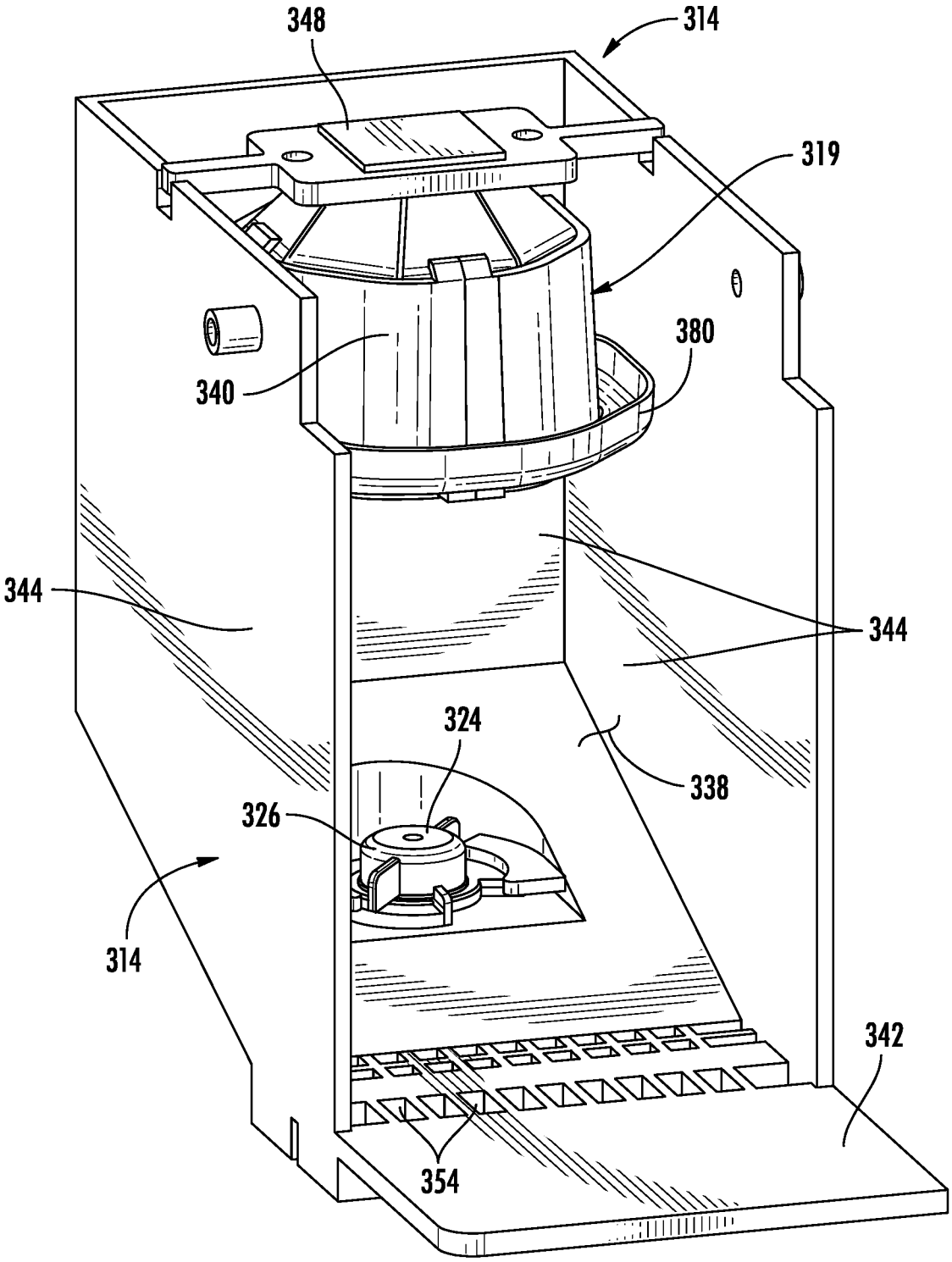
FIG. 9 provides a perspective view of an ice making assembly including a trough according to exemplary embodiments of the present disclosure.

Referring now specifically to FIG. 9, an exemplary primary water dispenser assembly (or primary water supply) 314, including a dispenser base 342 and one or more removable spray caps 326, that may be used with ice making assembly 300 will be described according to exemplary embodiments of the present disclosure. For instance, primary water supply 314 may be positioned within a receiving space 338 formed by a plurality of walls 344. Specifically, for example, dispenser base 342 and spray cap 326 may be used as (or as part of) guide ramp 330 and nozzle 324, respectively. Thus, the water dispenser may be positioned below (e.g., directly below) the ice mold 342 to direct an ice-building spray of water to the mold cavity 318. Although one discrete spray cap 326 is illustrated, any suitable number of spray caps (and thus corresponding ice building units 312) may be provided, as would be understood in light of the present disclosure.

Figure 8:
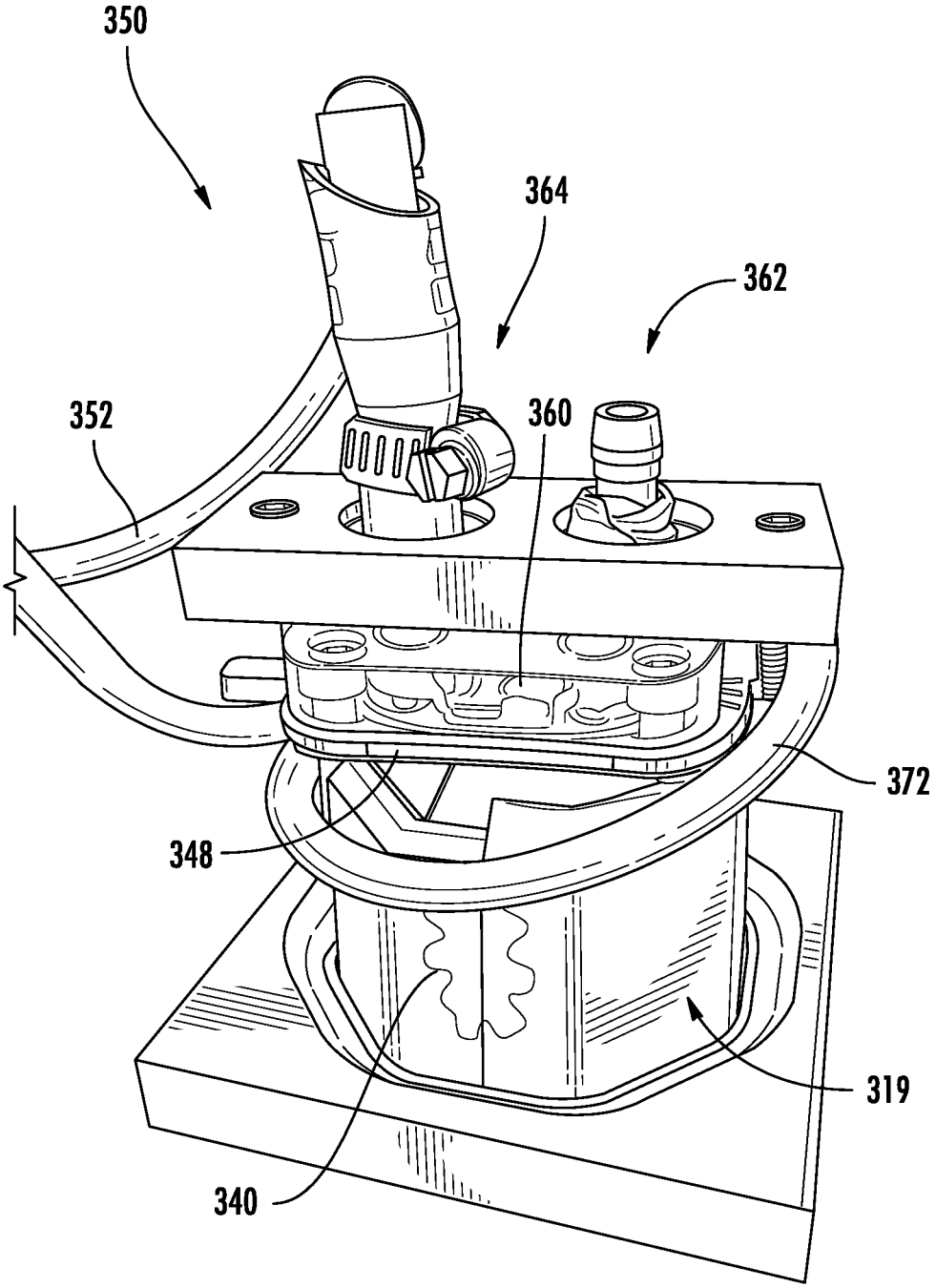
FIG. 8 provides a perspective view of an ice mold including a secondary water supply according to exemplary embodiments of the present disclosure.

With specific reference now to FIGS. 8 and 9, a secondary water supply 350 will be described in detail. In detail, secondary water supply 350 may be provided adjacent to conductive ice mold 340. For instance, secondary water supply 350 may surround exterior surface 319 of conductive ice mold 340. Secondary water supply 350 may selectively dispense, supply, or otherwise distribute water to exterior surface (or plastic cover) 319 of conductive ice mold 340. As will be described in more detail below, secondary water supply 350 may generate a water curtain that flows downward (e.g., along the vertical direction V) along exterior surface 319 of conductive ice mold 340. Accordingly, secondary water supply 350 may assist or aid in forming particular ice billets 320 as well as reducing a harvest time by discouraging ice buildup along exterior surface 319 of conductive ice mold 340.

Ice making assembly 300 may include a cooling pocket 360 attached to heat exchanger 348. As described above, heat exchanger 348 may be a thermoelectric heat exchanger having a hot side and a cold side, across which heat is transferred. The cold side of heat exchanger 348 may be attached to a top surface of conductive ice mold 340. The hot side of heat exchanger 348 may be attached to cooling pocket 360. Accordingly, cooling pocket 360 may be positioned above heat exchanger 348 (e.g., along the vertical direction V). In at least some examples, cooling pocket 360 is a computer processing unit (CPU) cooler. Accordingly, water (such as cooling water) may flow through cooling pocket 360 and absorb heat transferred from the hot side of heat exchanger 348.

Cooling pocket 360 may define an inlet 362 and an outlet 364. For instance, water (e.g., secondary water) may be introduced into cooling pocket 360 via inlet 362. The secondary water may be a different water flow (e.g., from a different water source) than the ice-building water spray. Accordingly, the secondary water may be referred to as ice-melting water. Upon being introduced into cooling pocket 360, the ice-melting water may circulate through cooling pocket 360 and absorb heat from heat exchanger 348. A flow path may be formed within cooling pocket 360, however the disclosure is not limited to this. The ice-melting water may then flow out of cooling pocket 360 via outlet 364.

Secondary water supply 350 may include a conduit 352. Conduit 352 may be fluidly connected with outlet 364 of cooling pocket 360. Accordingly, the ice-melting water may be introduced into conduit 352 after having absorbed heat within cooling pocket 360. At this point, the ice-melting water may have a relatively higher temperature than, for example, the ice-building water (e.g., water sprayed into mold cavity 318). For at least one example, the ice-building water may be between about 320 and about 34°, and the ice-melting water may be between about 34° and about 37°. In some embodiments, the ice-melting water may be motivated through cooling pocket 360 and secondary water supply 350 via a pump. For instance, a supply pump 370 (FIG. 7) may selectively supply water (e.g., municipal water) to each of water basin (or reservoir) 316 and cooling pocket 360. In at least some embodiments, supply pump 370 motivates water from reservoir 316 to cooling pocket 360. It should be noted that the ice-melting water may be supplied to cooling pocket 360 and dispensed via second water supply 350 throughout an ice making operation. In detail, when the ice-building water is sprayed toward mold cavity 318, the ice-melting water may also be dispensed over exterior surface 319 via second water supply 350.

Figure 12:
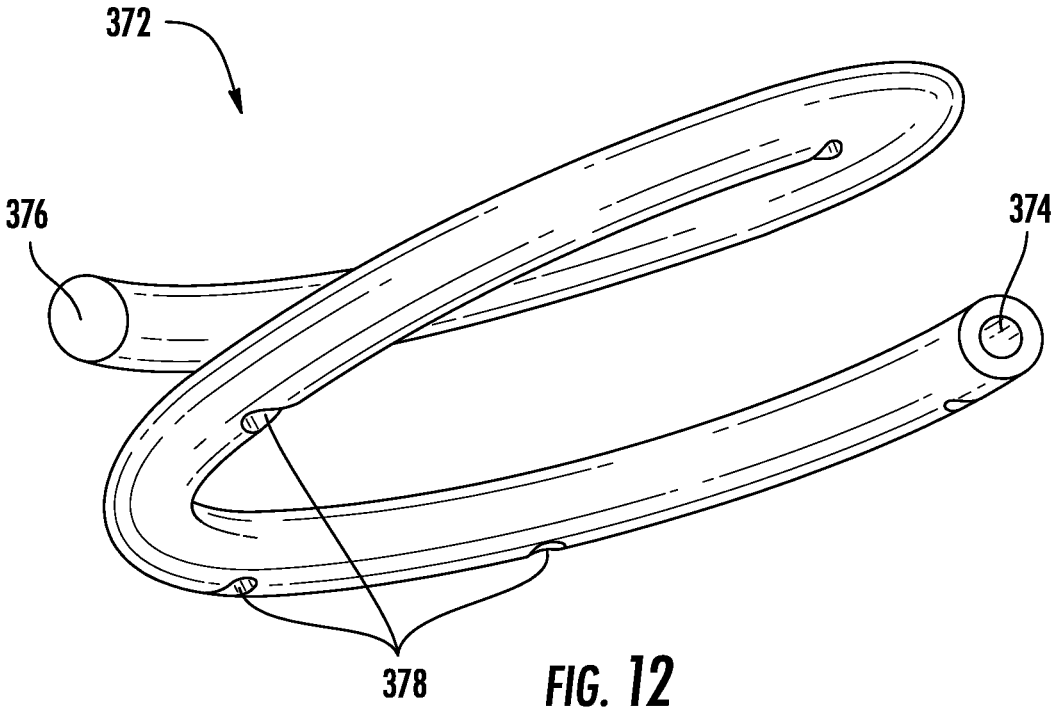
FIG. 12 provides a perspective view of a perforated tube according to an exemplary embodiment of the present disclosure.

Secondary water supply 350 may include a perforated tube 372. Perforated tube 372 may be coupled to a distal end of conduit 352. Accordingly, the ice-melting water from cooling pocket 360 may be supplied to perforated tube 372 via conduit 352. As shown best in FIG. 12, perforated tube 372 may include an open end 374 connected to conduit 352. Perforated tube 372 may further include a closed end 376 opposite open end 374. In detail, the ice-melting water supplied to perforated tub 372 may not exit or flow out of perforated tube 372 via closed end 374. Accordingly, perforated tube 372 may include a plurality of perforations 378 formed or defined therein. In detail, the plurality of perforations 378 may be formed through a circumferential surface of perforated tube 372. The plurality of perforations 378 may generally face inward (e.g., toward conductive ice mold 340). Moreover, the plurality of perforations 378 may be provided sequentially from open end 374 toward closed end 376. Accordingly, the ice-melting water supplied to perforated tube 372 may be dispensed evenly across exterior surface 319 of conductive ice mold (or plastic cover) 340.

Figure 13:
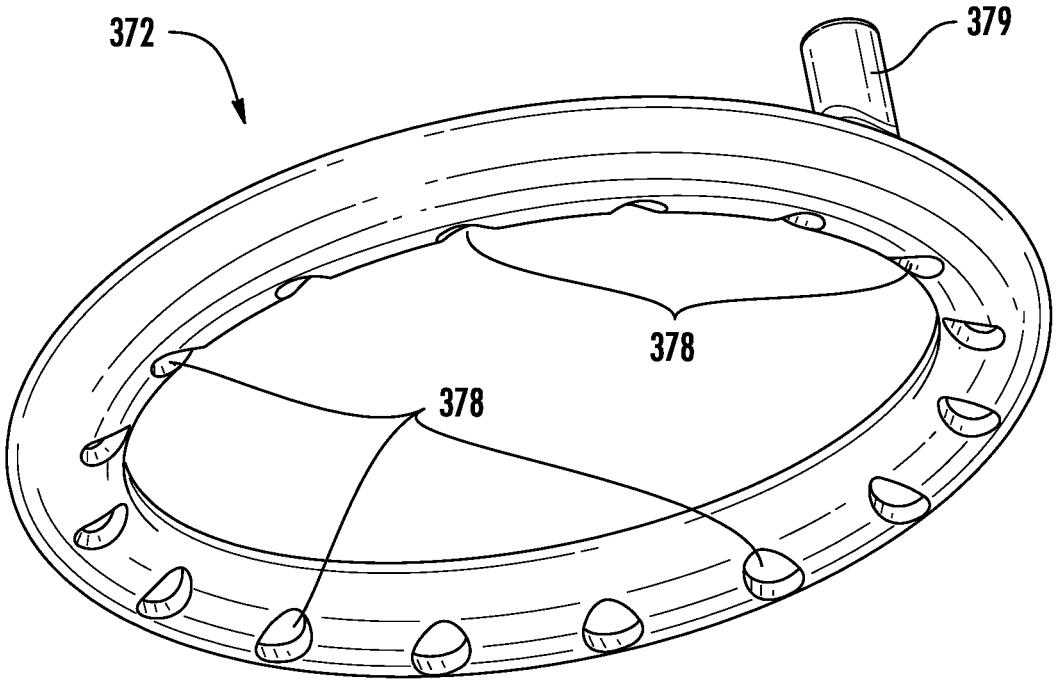
FIG. 13 provides a perspective view of a perforated tube according to another exemplary embodiment of the present disclosure.

Referring briefly to FIG. 13, another embodiment of perforated tube 372 is shown. As such, according to another embodiment, perforated tube 372 may be formed as a ring torus. According to this embodiment, perforated tube 372 defines a 3600 pathway through which the ice-melting water flows. Perforated tube 372 may thus include an inlet 379 to receive the ice-melting water. Inlet 379 may be fluidly connected with conduit 352 to receive ice-melting water therefrom. Similar to the embodiment described above, the plurality of perforations 378 may be formed through a surface of the ring torus (e.g., perforated tube 372). Thus, the ice-melting water supplied to perforated tube 372 via inlet 379 is dispensed via the plurality of perforations 378.

Secondary water supply 350 may include a trough 380. For this description, trough 380 (and conductive ice mold 340) may define an axial direction A, a radial direction R, and a circumferential direction C. For instance, trough 380 may be provided circumferentially around conductive ice mold 340 (e.g., around exterior surface 319). For instance, as shown in FIG. 9, trough 380 may be provided at or near a base or bottom of conductive ice mold 340. However, the location and placement of trough 380 may vary according to specific embodiments. Trough 380 may form a pathway for water (e.g., ice-melting water) to be received. For instance, the ice-melting water may be supplied to trough 380 via an open top of trough 380. In at least one embodiment (e.g., as shown in FIG. 8), the ice-melting water is supplied to trough 380 via perforated tube 372 (e.g., along the vertical direction V). However, it should be understood that the ice-melting water may be supplied to trough 380 via other means, such as through a separate conduit from supply pump 370, directly from cooling pocket 360, from a municipal water supply source, from the fresh food chamber, etc. Additionally or alternatively, the ice-melting water may be supplied to perforated tube 372 via other means, such as through a separate conduit from supply pump 370, directly from cooling pocket 360, from a municipal water supply source, from the fresh food chamber, etc. It should be understood that the ice-melting water may be supplied to secondary water supply 350 via any suitable means.

Trough 380 may include an inner radial wall 382 and an outer radial wall 384. Outer radial wall 384 may be taller (e.g., along the vertical direction V) than inner radial wall 382. Accordingly, a cross-section of tough 380 may form a "J" shape. A basin wall 386 may connect inner radial wall 382 with outer radial wall 384, such that the water (e.g., ice-melting water) is collected along basin wall 386. Because inner radial wall 382 is shorter than outer radial wall 384, the ice-melting water may spill over inner radial wall 382 upon reaching a predetermined height therein (or a predetermined volume). Thus, upon spilling over inner radial wall 382, the ice-melting water may trickle down along exterior surface 319 of conductive ice mold 340.

Figure 10:
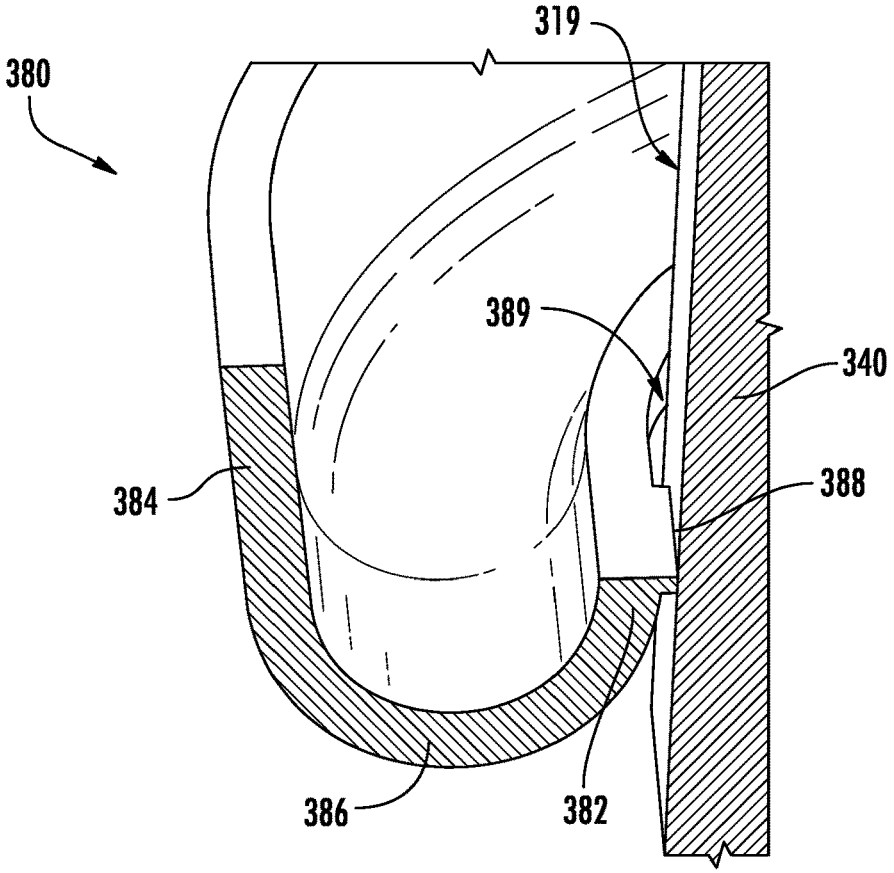
FIG. 10 provides a close up cut-away view of the exemplary trough of FIG. 9.
Figure 11:
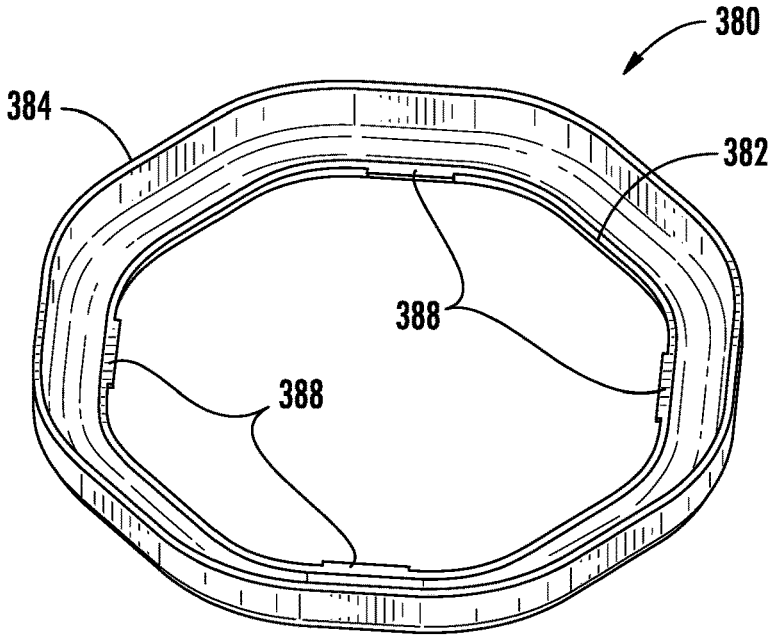
FIG. 11 provides a perspective view of the exemplary trough of FIG. 9, detached from the ice mold.

As seen in FIGS. 10 and 11, trough 380 may have a circumferential shape that is similar to a circumferential shape or cross-section of conductive ice mold 340. As seen particularly in FIG. 11, trough 380 may have an octagonal shape. According to this embodiment, trough 380 matches exterior surface 319 of conductive ice mold 340. Trough 380 may include one or more tabs 388 extending radially inward so as to contact exterior surface 319 of conductive ice mold 340. For instance, tabs 388 may extend from inner radial wall 382 (e.g., at a top portion thereof) toward conductive ice mold 340. A plurality of tabs 388 may be provided spaced apart from each other (e.g., along the circumferential direction). Thus, a plurality of gaps 389 may be formed between each of the plurality of tabs 388. When the ice-melting water spills over inner radial wall 382, the water may fall through each of the plurality of gaps along the exterior surface 319 of conductive ice mold 340.

In some embodiments, ice making assembly 300 includes both trough 380 and perforated tube 372. Accordingly, the ice-melting water may be circulated through cooling pocket 360 to absorb heat from heat exchanger 348. The ice-melting water may then be urged into perforated tube 372, e.g., via conduit 352. The ice-melting water may then flow, drip, or otherwise exit perforated tube 372 via perforations 378. At least a portion of the ice-melting water from perforations 378 may immediately contact exterior surface 319 of conductive ice mold 340 and begin to flow downward. At least another portion of the ice-melting water from perforations 378 may fall into trough 380. Once the predetermined volume of ice-melting water has been reached within trough 380, the ice-melting water seeps over inner radial wall 382 and onto exterior surface 319 of conductive ice mold 340.

After having passed over exterior surface 319, the ice-melting water may fall onto guide ramp 330, for example. As described above, guide ramp 330 may include one or more slots 354 or through holes defined through guide ramp 330 along the vertical direction V. The ice-melting water may flow along guide ramp 330 toward the slots 354. The slots may be positioned above water basin (reservoir) 316. Accordingly, the ice-melting water may be collected within interior volume 328 of reservoir 316. From here, the ice-melting water may mix with the ice-building water. As described above, supply pump 370 may selectively pump some of the water stored within reservoir 316 back into cooling pocket 360, while water pump 322 may pump some of the water stored within reservoir 316 toward conductive ice mold 340.

According to the embodiments described herein, a secondary water supply may be affixed to an automatic ice maker, for example, within a refrigerator appliance. The secondary water supply may selectively supply or dispense water, such as ice-melting water, over an external or exterior surface of an ice mold within the ice maker. The secondary water supply may include a cooling pocket such as a CPU cooler attached to a heat exchanger to absorb heat therefrom into water supplied thereto. The relatively heated water may be circulated through a conduit to a distribution point. The distribution point may include, for example, a perforated tube, a trough, both, or modifications to either or both. The water may then be dispensed over the exterior surface of the ice mold. Accordingly, the water from the secondary water supply (ice-melting water) may assist in forming ice billets within a cavity of the ice mold and reduce a harvest time by preventing a buildup of ice along the exterior surface of the ice mold.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An ice maker appliance comprising:

a plurality of walls forming a receiving space;

a conductive ice mold provided within the receiving space, the conductive ice mold defining an internal cavity and an exterior surface;

a primary water supply positioned below the conductive ice mold to direct an ice-building spray of water to the internal cavity of the conductive ice mold;

a heat exchanger disposed on the conductive ice mold to draw heat therefrom; and a secondary water supply provided adjacent the exterior surface of the conductive ice mold, the secondary water supply comprising a perforated tube circumferentially surrounding the exterior surface of the conductive ice mold, wherein the secondary water supply dispenses ice-melting water over the exterior surface of the conductive ice mold.

2. The ice maker appliance of claim 1, wherein the perforated tube comprises an open end configured to receive the ice-melting water and a closed end opposite the open end such that the ice-melting water is dispensed from the perforated tube via a plurality of perforations defined therein.

3. The ice maker appliance of claim 1, wherein the perforated tube is a ring torus comprising an inlet to receive the ice-melting water and a plurality of outlets defined through a surface of the ring torus.

4. The ice maker appliance of claim 1, wherein the secondary water supply comprises:

a trough provided circumferentially around the exterior surface of the conductive ice mold, the trough comprising a plurality of tabs extending radially inward to contact the exterior surface of the conductive ice mold, wherein the trough is configured to receive the ice-melting water.

5. The ice maker appliance of claim 4, wherein each of the plurality of tabs is spaced apart along a circumferential direction such that a plurality of gaps is formed between the trough and the exterior surface of the conductive ice mold between the plurality of tabs, and wherein the ice-melting water flows from the trough through the plurality of gaps.

6. The ice maker appliance of claim 5, wherein the secondary water supply further comprises:

a perforated tube circumferentially surrounding the exterior surface of the conductive ice mold, the perforated tube being provided above the trough along a vertical direction.

7. The ice maker appliance of claim 1, wherein the heat exchanger is a thermoelectric heat exchanger attached to a top of the conductive ice mold.

8. The ice maker appliance of claim 7, further comprising:

a cooling pocket attached to a top surface of the thermoelectric heat exchanger, the cooling pocket configured to allow water to be cycled therethrough via an inlet and an outlet; and a conduit attached to the outlet of the cooling pocket, the conduit being connected with the secondary water supply.

9. The ice maker appliance of claim 8, further comprising:

a reservoir provided below the primary water supply and configured to store water therein; and a pump provided within the receiving space and configured to pump water into each of the cooling pocket and the reservoir.

10. The ice maker appliance of claim 9, wherein the ice-melting water dispensed from the secondary water supply is collected within the reservoir after passing over the conductive ice mold.

11. A refrigerator appliance comprising:

a cabinet defining one or more chilled chambers;

a refrigerant system mounted within the cabinet to selectively cool the one or more chilled chambers, the refrigerant system comprising a compressor and an evaporator in fluid communication with the compressor; and an ice maker mounted within one of the one or more chilled chambers, the ice maker comprising:

a plurality of walls forming a receiving space;

a conductive ice mold provided within the receiving space, the conductive ice mold defining an internal cavity and an exterior surface;

a primary water supply positioned below the conductive ice mold to direct an ice-building spray of water to the conductive ice mold;

a heat exchanger disposed on the conductive ice mold to draw heat therefrom;

a secondary water supply provided adjacent the exterior surface of the conductive ice mold, wherein the secondary water supply dispenses ice-melting water over the exterior surface of the conductive ice mold; and a trough provided circumferentially around the exterior surface of the conductive ice mold, the trough comprising a plurality of tabs extending radially inward to contact the exterior surface of the conductive ice mold, wherein the trough is configured to receive the ice-melting water.

12. The refrigerator appliance of claim 11, wherein the ice maker further comprises:

a perforated tube circumferentially surrounding the exterior surface of the conductive ice mold.

13. The refrigerator appliance of claim 12, wherein the perforated tube comprises an open end configured to receive the ice-melting water and a closed end opposite the open end such that the ice-melting water is dispensed from the perforated tube via a plurality of perforations defined therein.

14. The refrigerator appliance of claim 12, wherein the perforated tube is a ring torus comprising an inlet to receive the ice-melting water and a plurality of outlets defined through a surface of the ring torus.

15. The refrigerator appliance of claim 11, wherein each of the plurality of tabs is spaced apart along a circumferential direction such that a plurality of gaps is formed between the trough and the exterior surface of the conductive ice mold between the plurality of tabs, wherein the ice-melting water flows from the trough through the plurality of gaps.

16. The refrigerator appliance of claim 15, wherein the secondary water supply further comprises:

a perforated tube circumferentially surrounding the exterior surface of the conductive ice mold, the perforated tube being provided above the trough along a vertical direction.

17. The refrigerator appliance of claim 11, wherein the heat exchanger is a thermoelectric heat exchanger attached to a top of the conductive ice mold.

18. The refrigerator appliance of claim 17, further comprising:

a cooling pocket attached to a top surface of the thermoelectric heat exchanger, the cooling pocket configured to allow water to be cycled therethrough via an inlet and an outlet; and a conduit attached to the outlet of the cooling pocket, the conduit being connected with the secondary water supply.

* * * * *